United States Patent [19]

Davies et al.

[11] Patent Number: 4,532,719

[45] Date of Patent: Aug. 6, 1985

[54] METHOD AND DEVICE FOR CONDITIONING FABRICS IN A TUMBLE-DRYER

[75] Inventors: James F. Davies; Arthur G. Leigh; George K. Rennie, all of Merseyside, England

[73] Assignee: Lever Brothers Company, New York, N.Y.

[21] Appl. No.: 586,957

[22] Filed: Mar. 7, 1984

[30] Foreign Application Priority Data

Mar. 8, 1983 [GB] United Kingdom ..... 8306308

[51] Int. Cl.[3] ..... F26B 3/04

[52] U.S. Cl. ..... 34/12; 252/8.8; 427/242; 427/394; 428/260; 34/60

[58] Field of Search ..... 427/242, 394, 425; 252/8.8, 357, 51.5, 51.5 A; 428/260; 34/60, 12

[56] References Cited

U.S. PATENT DOCUMENTS

| | | | |
|---|---|---|---|
| B 305,417 | 1/1975 | Nirschl et al. . | |
| 3,442,692 | 5/1969 | Gaiser . | |
| 3,706,140 | 12/1972 | Brillaud et al. | 34/60 |
| 3,843,395 | 10/1974 | Morton . | |
| 3,896,033 | 7/1975 | Grimm . | |
| 3,945,936 | 3/1976 | Lucas et al. . | |
| 4,041,205 | 8/1977 | Compa et al. . | |
| 4,049,858 | 9/1977 | Murphy . | |
| 4,096,071 | 6/1978 | Murphy . | |
| 4,121,009 | 10/1978 | Chakrabarti | 428/260 |
| 4,242,377 | 12/1980 | Roberts et al. . | |

FOREIGN PATENT DOCUMENTS

| | | |
|---|---|---|
| 52813/73 | 9/1974 | Australia . |
| 1121111 | 4/1982 | Canada . |
| 28380A | 11/1979 | European Pat. Off. . |
| 65387 | 11/1982 | European Pat. Off. . |
| 95335 | 11/1983 | European Pat. Off. . |
| 2635256 | 2/1978 | Fed. Rep. of Germany . |
| 1313697 | 4/1973 | United Kingdom . |
| 1329429 | 9/1973 | United Kingdom . |
| 1453093 | 10/1976 | United Kingdom . |
| 1482782 | 8/1977 | United Kingdom . |
| 1517377 | 7/1978 | United Kingdom . |
| 1522998 | 8/1978 | United Kingdom . |
| 1544863 | 4/1979 | United Kingdom . |
| 2013260A | 8/1979 | United Kingdom . |
| 1566506 | 4/1980 | United Kingdom . |
| 1578951 | 11/1980 | United Kingdom . |
| 2066309A | 7/1981 | United Kingdom . |

OTHER PUBLICATIONS

Copending U.S. patent application Ser. No. 494,143, (Rennie).

*Primary Examiner*—Larry I. Schwartz

*Attorney, Agent, or Firm*—Lynne Darcy; James J. Farrell

[57] ABSTRACT

A method for conditioning fabrics in the tumble-dryer comprises applying to the fabrics a fabric conditioner in fine free-flowing powder form and containing a substantial proportion of a water-soluble soap blend containing significant proportions of $C_{12}$, $C_{14}$, $C_{16}$ and $C_{18}$ soaps, preferably a blend of 45–85% tallow soap and 15–55% coconut soap. The powder is advantageously applied from a sprinkling device that moves freely among the fabrics.

31 Claims, 1 Drawing Figure

Fig. 7.
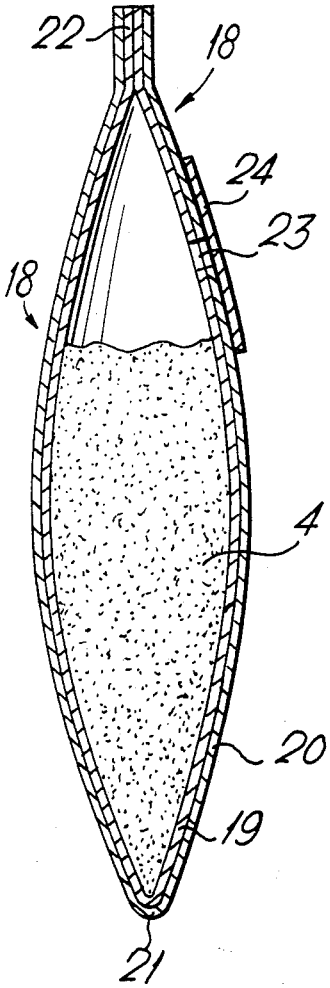
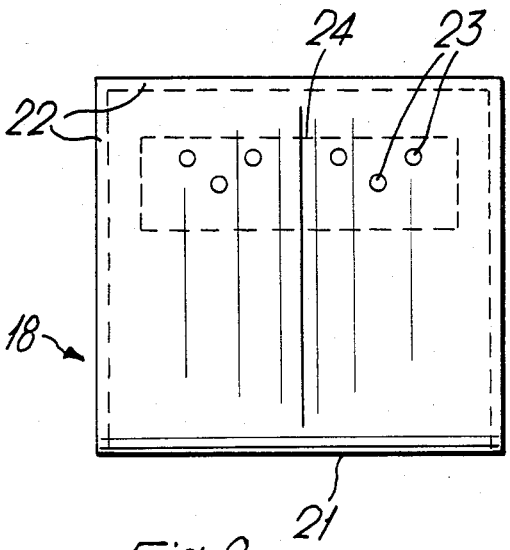
Fig. 8.

Fig. 9.
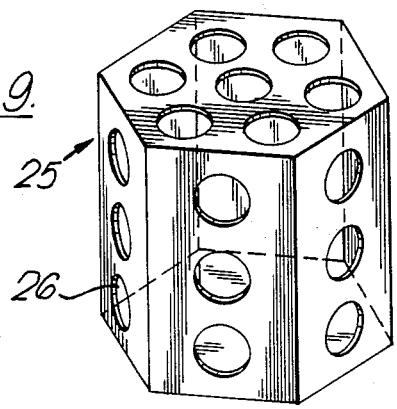
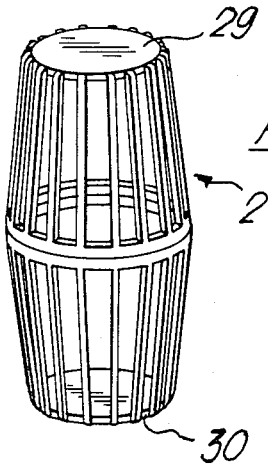
Fig. 10.
Fig. 11.
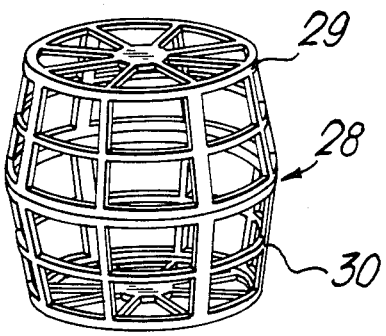

METHOD AND DEVICE FOR CONDITIONING FABRICS IN A TUMBLE-DRYER

The present invention relates to a method and device for conditioning fabrics in a tumble-dryer. The term "conditioning" is used herein to mean the imparting of certain consumer benefits, including softness and reduced static cling, to washed fabrics. In the process of the invention, a fabric conditioning agent in the form of a free-flowing powder and consisting wholly or predominantly of powdered soap is applied directly to the fabrics before or during drying in the tumble-dryer.

The use of soaps as fabrics conditioning agents in the tumble-dryer has been mentioned in passing in a number of prior disclosures, but the application of powdered compositions containing a high proportion of water-soluble soaps directly to damp fabrics prior to or during the drying cycle has not been disclosed.

An early disclosure relating to fabric conditioning in the tumble-dryer is U.S. Pat. No. 3,442,692 (Gaiser), which discloses the method of conditioning washed fabrics during drying in a tumble-dryer, wherein a fabric conditioning agent is carried on a sheet substrate, such as a conventional paper towel, which is tumbled with the fabrics. The sheet substrate is impregnated with the conditioning agent, which is generally a quaternary ammonium compound or other cationic material.

The Gaiser patent has been followed by many others relating to fabric conditioning articles in the form of impregnated or coated sheet substrates. The preferred fabric conditioning agents are cationic and nonionic materials, but soaps and other anionic materials are sometimes listed as alternatives. Examples of this type of disclosure are GB No. 2 013 260A (Herbert Glatt), CA No. 1 121 111 (Purex Corporation), U.S. Pat. No. 3,843,395 (Morton, Procter & Gamble), and GB No. 2 066 309A (Colgate). With this type of sheet article, the degree and uniformity of transfer of conditioning agent from the sheet to the fabrics by rubbing during tumble-drying are generally poor unless a spreading or distributing agent is also present, as disclosed, for example, in GB No. 1 313 697 (Unilever). Distributing agents used in such articles include sorbitan esters and other nonionic materials.

Other disclosures that mention soaps in lists of possible ingredients of non-particulate fabric conditioning compositions for tumble-dryer use are U.S. Pat. No. 4,041,205 (Compa et al, Colgate-Palmolive), which relates to tablets, and U.S. Pat. No. 4,242,377 (Colgate-Palmolive), which relates to aerosol foam compositions.

U.S. Pat. Nos. 4,049,858 and 4,096,071 (Murphy, Procter & Gamble) disclose a fabric softening composition comprising a sorbitan ester, together with a phase modifier (a soap or an alkyl sulphate) in a ratio of 100:1 to 1:1. The composition may be applied to the fabric load prior to drying as a foam or dispersion or by sprinkling from a shaker; or it may be enclosed in a hollow, open-pore polyurethane foam sponge pouch which is placed in the dryer with the fabrics.

The application of fabric conditioning agents in powder or granule form to fabrics prior to or during the drying cycle has also been described in the patent literature. AU No. 52813/73 (Economics Laboratory) discloses this general concept, the powdered fabric conditioning agent (distearyl dimethyl ammonium chloride) being scattered manually on the fabrics before the start of the drying cycle, or being sprinkled during drying from a perforated dispenser analogous to a salt-shaker. Scattering or dispersing of conditioning agents in powder form is also disclosed in GB Nos. 1 517 377 and 1 522 998 (Procter & Gamble).

The use of soap as a possible coating agent for minor ingredients of particulate conditioning compositions is disclosed in GB No. 1,578,951 (Procter & Gamble) and U.S. Pat. No. 3,945,936 (Lucas, Procter & Gamble).

GB No. 1 482 782 (Procter & Gamble) discloses fabric conditioning compositions that impart crispness to the fabric. The compositions contain nonionic surfactant and a crisping component insoluble in water that may be a fatty alcohol, a fatty acid, or an insoluble (calcium or magnesium) soap of a fatty acid. The composition may be dispensed from a hollow sponge, a bag or a sheet substrate, or manually scattered, in granular form, onto the fabrics before the start of the drying cycle.

U.S. Pat. No. 3,896,033 (Grimm, Colgate-Palmolive Co.) discloses a fabric softener in particulate form for use in the tumble-dryer. The particulate softener comprises a fabric softener compound coated with a suitable non-staining protective and release-controlling material, normally an organic polymer, and has a particle size of 0.02 to 5 mm. Many different fabric softening compounds are listed, among them the higher fatty acid soaps such as the sodium soap of 80-tallow 20-coconut oil mixture. The particulate fabric softening agent may suitably be applied to the fabrics from a substrate such as an open celled polyurethane foam sponge strip.

As indicated previously, the subject of the present invention is an improved fabric conditioning method and device using a soap based fabric conditioning agent in the form of a simple, uncoated free-flowing powder. No substrate or spreading agent is required although, as described later, a dispensing device may if desired be used.

In a first aspect, the present invention provides a method of conditioning fabrics, which comprises tumbling damp fabrics under the action of heat in a laundry dryer together with a conditioning agent in the form of a free-flowing powder and having a particle size range within the range of from 20 to 1000 μm, said powder consisting to an extent of at least 55% by weight of one or more water-soluble soaps of $C_8$ to $C_{22}$ saturated or unsaturated fatty acids, said soap blend containing at least 5% by weight of $C_{12}$ soap, at least 5% by weight of $C_{14}$ soap, at least 12% by weight of $C_{16}$ soap and at least 20% by weight of $C_{18}$ soap, said soap blend being in the form of a powder free of any protective coating.

It has been found that soap blends as defined above, when applied as a free-flowing powder to fabrics in the tumble-dryer, are highly effective fabric softeners and also reduce static cling; this latter property can be further improved by the inclusion of a minor proportion of cationic material. The particles, scattered on the fabrics before drying or during the early part of the drying cycle, initially adhere to the damp fabric and then spread to cover the fabrics.

It is an essential feature of the present invention that the conditioning agent be in powder form. Soap applied as a coating or impregnant on a sheet substrate, without distributing agent, was found to be delivered very poorly to the fabrics, so that very little softening benefit was obtained; a substantial proportion of the soap remained on the sheet substrate. According to the present invention, on the other hand, 100% delivery of the conditioning agent to the fabrics may easily be achieved without the use of a distributing agent.

The particle size of the powder will influence the speed and uniformity of delivery. Particle sizes above 1000 μm have been found to give in sufficiently uniform conditioning, and thus powders having particle sizes above this figure, which may more properly be regarded as granules, are outside the scope of the invention. The smaller the particle size of the powder, the greater the uniformity of its distribution on the fabrics in the dryer; but a particle size smaller than 20 μm is undesirable on safety grounds because of its respirability. A preferred particle size range is 70 to 500 μm, more preferably 90 to 250 μm.

The powdered conditioning agent used according to the invention consists, to an extent of at least 55% by weight, preferably 65% by weight, of the soap blend as defined above. The cation is generally alkali metal, preferably sodium or potassium; ammonium; or substituted ammonium, for example, triethanolamine. The blend preferably contains at least 7% by weight of $C_{12}$ soap, especially from 7 to 27%; at least 6% by weight of $C_{14}$ soap, especially from 6 to 12%; at least 15% by weight of $C_{16}$ soap, especially from 18 to 28%; and at least 25% by weight of $C_{18}$ soap, especially from 32 to 54% by weight.

The soap blend used in the process of the invention thus contains significant amounts of four different chain lengths, the spread of chain lengths—from $C_{12}$ to $C_{18}$—being relatively wide.

The blend may contain both saturated and unsaturated soaps. Advantageously the blend contains at least 15% by weight of $C_{18}$ unsaturated soap, preferably at least 20% by weight and especially from 22 to 38% by weight.

Single-chain-length soaps show a slight fabric softening effect, as do soap blends having a limited chain length spread, such as tallow soap and coconut soap. All these soaps, however, are inferior softeners to commercially available impregnated sheets carrying cationic fabric conditioner and spreading agent.

Surprisingly, however, blends having a wider and more balanced chain length spread, obtainable by mixing tallow and coconut soaps, have been found to give highly efficient softening which, at a dosage of 3 g per fabric load, is consistently as good as, if not better than, that obtained using the impregnated sheet type of article. These blends may advantageously contain from 45 to 85% by weight of tallow soap, the balance being coconut soap.

Commercial blends of coconut and tallow soaps as used in toilet soap bars and fabric washing soap flakes have been found to offer excellent softening performance. These blends may in some cases be superfatted, that is to say, they contain up to about 10% by weight of free fatty acids. This appears not to be detrimental in terms of softening performance, but can make the milling of the soap to a free-flowing powder more difficult.

The chain length distribution of some typical blends, together with those of tallow and coconut soaps, are shown in the Table.

According to a first preferred embodiment of the invention, the powdered conditioning agent consists entirely of soap. This has the merits of cheapness, technical simplicity and environmental innocuousness.

Alternatively, blends of soap (55% by weight or more) with lesser amounts of other materials may be used. Since soap already has excellent delivery and softening characteristics, no additional materials such as distributing agents are required to improve those properties, and since soaps are cheap and easy to handle, it will not generally be necessary to include other materials on cost reduction or processing grounds. Any additional materials used may thus be chosen purely to enhance the overall fabric conditioning effect, for example, to improve the reduction of static cling or to impart crispness, perfume or easy-iron characteristics. Of course these additional materials must be available in free-flowing powdered form, whether as such or coated or encapsulated.

| Chain length | Tallow | Coconut | Tallow/coconut blends (wt %) 85/15 | 80/20 | 60/40 | 45/55 |
|---|---|---|---|---|---|---|
| $C_8$ | — | 7.0 | 1.0 | 1.5 | 3.0 | 3.8 |
| $C_{10}$ | — | 8.1 | 1.2 | 1.6 | 3.2 | 4.5 |
| $C_{12}$ | — | 48.0 | 7.2 | 9.6 | 19.2 | 26.4 |
| $C_{14}$ | 4.5 | 17.5 | 6.5 | 7.0 | 9.7 | 11.7 |
| $C_{16}$ | 30.6 | 9.0 | 27.4 | 26.3 | 21.9 | 18.7 |
| $C_{18}$ sat. | 19.2 | 2.1 | 16.6 | 15.8 | 12.3 | 9.8 |
| $C_{18}$ unsat. | 42.7 | 5.7 | 37.2 | 35.3 | 27.9 | 22.4 |
| Other | 3.0 | 2.6 | 2.9 | 2.9 | 2.8 | 2.7 |

In a second preferred embodiment of the invention, the powdered fabric composition soap in combination with a lesser amount of a cationic material capable of reducing static cling, the latter also being in free-flowing powder form. Only small proportions of cationic material are required to give substantial elimination of static cling even with synthetic fabrics; the ratio of soap to cationic material is preferably within the range of from 12:1 (92% soap if no other ingredients are present) to 1.5:1 (60% soap if no other ingredients are present), more preferably from 11:1 to 2:1. Thus excellent reduction of static cling can be obtained using much smaller amounts of cationic materials than in conventional rinse conditioners or sheet substrate tumble-dryer conditioners. This is beneficial from both cost and environmental standpoints.

Preferred cationic materials are quaternary ammonium salts containing two long-chain alkyl groups and two lower alkyl groups, for example, di(hardened tallow alkyl) dimethyl ammonium chloride and methosulphate. One suitable material is Arosurf (Trade Mark) TA 100 ex Ashland Chemical Company, which is a dry, free-flowing, 95% active form of distearyl dimethyl ammonium chloride.

The conditioning agent may advantageously contain a perfume, which is preferably fabric-substantive. This may if desired by protected by encapsulation.

The amount of powdered conditioning agent used per fabric load will of course depend both on the fabric load and the size of the machine. For use in a domestic UK or European tumble-dryer, amounts of from 1.5 to 12 g, preferably from 2.5 to 10 g and especially from 2.5 to 7 g, have been found to be optimum.

The powdered conditioning agent may simply be scattered by hand onto the fabrics in the tumble-dryer before the dryer is switched on, but in a preferred embodiment of the powdered conditioning agent is contained within a dispensing device and is sprinkled onto the fabrics during the actual drying process.

The dispensing device may be fixed to an internal surface of the dryer, either a stationary surface such as the door or, preferably, a moving surface such as the drum wall. More preferably, however, the dispensing device is loose in the dryer and moves freely among the fabrics as drying progresses.

The use of a dispensing device allows the scattering of the conditioning agent onto the fabrics to take place gradually during the early part of the drying cycle, rather than instantaneously. The powder should all be dispensed onto the fabric while the fabrics are still damp enough for the powder to adhere to them. The time over which the powder should be dispensed accordingly depends on the fabric load and its initial water content, as well as on the tumble dryer itself. For UK or European tumble dryers it has been found that the powder should preferably be dispensed over a period of at least 2.5 minutes and not exceeding 20 minutes, preferably not exceeding 10 minutes. For successful dispensing the conditioning agent must obviously remain in fine powder form while it is inside the dispensing device; conversion to a fluid form must take place later when the powder has been deposited on the fabrics. It has been found that the soap-based powdered conditioning agent used according to the present invention has excellent characteristics in this respect.

The use of a dispensing device also allows more accurate control of the amount of conditioning agent, especially if it is of the disposable unit dose type containing the correct amount of conditioning agent for a single load. Such a dispensing device may take the form of a small container having openings of a size such that gradual and uniform dispensing of the powder will occur.

Accordingly, in a second aspect, the present invention provides an article for conditioning fabrics in a tumble-dryer, comprising a container having a plurality of openings the largest dimension of which does not exceed 2.5 mm, and containing from 1.5 to 12 g of a fabric conditioning agent in the form of a free-flowing powder having a particle size range within the range of from 20 to 1000 μm, and consisting to an extent of at least 55% by weight of the soap blend defined previously, in the form of a powder free of any protective coating.

The container is of such a size that it can contain the appropriate quantity (1.5 to 12 g) of conditioning agent and deliver it at an appropriate rate. It should not be too small, or it will become caught among the fabrics.

The hole size of the container is advantageously matched to the particle size of the powdered conditioning agent, so that the latter is dispensed in a controlled manner. For example, if the particle size is within the preferred range of 70 to 500 μm, the inner container is advantageously substantially free of openings larger than 2000 μm, and more preferably substantially free of openings larger than 1000 μm. Use of an inner container having a hole size approximately equal to the largest particle size of the powder used gives especially uniform conditioning. Some powders may, however, have a tendency to agglomerate under tumble-dryer conditions to form larger particles and in this case the openings must be sufficiently large to accommodate the agglomerate.

In a preferred embodiment of the invention, the inner container is a sachet of flexible sheet material provided over part or whole of its surface with openings to provide permeability to the powder. Suitable materials include paper, nonwoven fabrics, plastics films, and laminates of these. If desired, one or more sachet walls may be constituted by a material provided with openings uniformly over its whole surface; an example of a highly suitable material of this type is the paper used to make tea and coffee bags. This has been found to be suitable for dispensing powders having a particle size of less than 250 μm.

Alternatively an essentially non-porous material may be used and provided with a chosen number of perforations or slits of a chosen size in a chosen arrangement; this second possibility is preferred when relatively large, for example, 2000 μm, openings are required.

The sachet or other container is preferably provided with a removable outer covering, impermeable to the powdered conditioning agent, which covers all the openings and is in intimate contact with the container in the region of the openings, so as to prevent premature escape of the powder. This outer covering is removed by the consumer immediately before placing the container in the tumble-dryer.

Advantageously, the sachet or other container may be placed, for use in the tumble dryer, within a larger, also powder-permeable container. This arrangement means that at the beginning of the drying cycle the smaller container is prevented from coming into direct contact with the damp fabrics and with water droplets, which contact could cause clogging. The use of an outer container also helps to reduce the incidence of local overloading of conditioner, and hence spotting and staining. Furthermore, the inner container may be smaller without catching in the fabrics, because additional size is provided by the outer container.

The outer container may be, for example, a sachet or bag within which the small inner container preferably fits rather loosely. A loose fit is preferred because it lessens the chance of direct contact of the bulk of the powder in the inner container with damp fabrics or water droplets. The outer container is advantageously reusable and can be refilled with disposable inner containers; it may be closable, for example, by means of a drawstring, elastic, press-studs, a zip-fastener or the like. The outer bag may be made, for example, of a suitably open-weave textile material; or it may be similar in materials and construction to the sachet embodiment of the inner container described previously.

In a highly preferred embodiment of the present invention, the powdered soap-based fabric conditioning agent is dispensed during tumble-drying by means of a device as described and claimed in GB No. 2 122 657A (Unilever). In that device, the powdered fabric conditioning agent is disposed within a first container of material permeable to said composition in powder form, the first container being disposed within a second container having openings for the egress of said composition in powder form, the second container being substantially form-retaining and of a shape such as to allow ready movement thereof among the fabrics in a dryer.

The outer container is substantially form-retaining, but need not be completely rigid. It should not be significantly deformed by the tumbling fabrics as it moves among them. Furthermore the container should be to some extent energy-absorbing, and thus sound-absorbing, so that the noise it makes on impact with the drum is not excessive, thus some flexing of the container walls is desirable.

The shape and size of the outer container should be such that it moves freely among the fabric load under the motion of the dryer and distributes its contents as uniformly as possible. The outer surface should be as smoothly contoured as possible, and free of protrusions and sharp edges that can catch on the fabrics. In principle any shape is suitable provided that angles between adjacent faces are not too small; any edges and corners are advantageously rounded off. The ratio of the principal axes (major to minor) is preferably not greater than 5:1, and is advantageously 2:1 or less, a ratio of approximately 1:1 being especially preferred.

The ideal shape appears to be spherical or substantially spherical, and spheroidal, ellipsoidal, cylindrical and frustoconical shapes are also highly advantageous. Other shapes of interest include cubes, hexagonal prisms, and pairs of frustocones abutting at their larger ends, and other possible shapes will readily suggest themselves to one skilled in the art.

It has been found experimentally that, when using UK or European tumble-dryers, the largest dimension of the outer container is preferably at least 6 cm. Smaller containers tend to become caught among the fabrics.

The outer container can be of any reasonable mass, but should not be too heavy, otherwise damage to the dryer could result.

Of course the material of the outer container must be relatively robust, as it will be knocked frequently against the walls of the dryer and compressed by the fabrics. It must also be stable at the temperatures encountered in the dryer, which generally should not exceed 70° C. but may rise to 100° C. or above in old or poorly maintained machines. Accordingly the material of the outer container is preferably stable at temperatures up to at least 130° C., and preferably up to about 170° C.

Suitable materials include thermoplastic and thermosetting resins, wood, resin-bonded cardboard, papier-mache and casein, natural and synthetic rubbers, and lightweight metals, for example aluminium. Materials that are unsuitable for contact with wet fabrics, for example cardboard, may be protected by a coating of, for example, rubber or plastics material or metal foil. Many other lightweight, robust and heat-stable materials will readily suggest themselves to the skilled worker in the art.

Thermoplastic materials of sufficiently high softening point (preferably above 130° C.) and robustness offer manufacturing advantages in that suitable shapes can readily be made by moulding techniques such as injection, extrusion or blow-moulding. Preferred materials include polystyrene, high-density polyethylene and, in particular, polypropylene. The softening point of the last-mentioned material is above 130° C.

The outer container is provided with openings, for example, slits or circular holes, through which the powdered conditioning agent passes. These are larger than the openings in the inner container so that they provide no impedance to the passage of the powdered conditioning agent. Preferably the total area of the openings in the outer container is at least 3 times as large as the total area of the openings in the inner container, and advantageously at least 5 times as large. The individual openings are desirably as large as possible provided that the inner container cannot fall out and the outer container has sufficient integrity and robustness. The shape of the openings is not important as far as delivery of the powder is concerned, but may have some influence on the strength and flexibility of the outer container and its noisiness in use. It has been found, for example, that in the case of a spherical polypropylene container the use of elongate slits rather than circular holes gives substantially less noise in use, presumably because of greater flexibility.

Optionally the surface of the outer container, especially the inner surface and the edges of the openings, may be rendered to some extent hydrophobic (if not inherently so) to prevent or reduce the penetration into its interior of water droplets, which may collect on the outer surface at an early stage in the dryer cycle.

The interior of the outer container may optionally be provided with means for keeping the inner container at a distance from its outer wall(s) and thus ensuring that no direct contact with damp fabrics or water droplets occurs. The inner wall(s) may, for example, be provided with protrusions which act as spacers. Alternatively, locating means, such as pins or pegs, may be provided to hold the inner container in a fixed position; this measure has the advantage that in the case of a flexible inner container such as a sachet in the latter is prevented from becoming crumpled up. Where the outer container is injection-moulded, such pins or pegs may readily be formed as an integral part of it. Spacer ribs or other protrusions as mentioned above may also easily be formed in this way.

As mentioned previously, the inner container may be rigid or flexible but if free to move around in the outer container is preferably flexible. This is for noise reasons. If, however, locating means as described in the previous paragraph are provided in the outer container, a rigid inner container may if desired be used without creating a noise problem.

Advantageously the outer container is sufficiently robust to be reusable, and is so constructed that an inner container may readily be inserted or removed. Thus multiple use of the outer container with a succession of inner containers is possible. Furthermore two inner containers may be used at once if a particularly large load is contemplated. The outer container may, for example be so designed that, by flexing, one of its apertures may be enlarged to a sufficient extent that an inner container can be inserted or removed. More conveniently, the outer container may be constructed in two or more parts that can readily be separated and rejoined. The parts may if desired be connected by a hinge or the like so that they never become completely separated. The parts should join up by a mechanism that leaves the outer surface of the closed container as smooth as possible, and that will not accidentally come open during use in the tumble-dryer. Examples of suitable mechanisms include snap-fit, a lock screw, and internal hooks joined by elastic.

If a succession of inner containers is to be used with the same outer container, it may be unnecessary to remove the spent inner containers before inserting a new one, if the inner containers are of a type, for example, a flexible sachet, that once empty occupies little space. In practice it has been found that ten sachets may be used successively within a slitted polypropylene sphere without removing the empty sachets.

If the outer container is reusable and full inner containers are separately available as refills, it is clearly desirable for these inner containers to be provided with outer packaging or covering in order to prevent premature discharge of their contents. The outer packaging or covering is advantageously also moisture-proof in order to protect the powdered conditioning agent from atmospheric moisture during storage and handling prior to use.

It is essential that such outer packaging or covering be in intimate contact with all surface regions of the inner container that are permeable to the powdered conditioning agent. If space is left between the two, powder will escape into that space and will be lost when the outer packaging or covering is removed.

The outer packaging or covering is thus preferably a flexible sheet material that can be made to conform intimately and accurately to any permeable surface region of the inner container.

Any film or sheet that can be made to adhere to the inner container and subsequently removed is in principle suitable, the choice of material depending among other things on the material used for the inner container itself and the area required to be covered.

In the case of a tea-bag-like sachet where a relatively large area of the sachet, possibly the whole of it, is powder-permeable and needs an outer covering, the outer covering is preferably a relatively durable material impermeable to moisture and perfume so that the product has a reasonable storage life. Materials that can be heat-sealed, either inherently or with the aid of hot-melt adhesives, are especially advantageous.

Plastic films may be suitable, but thin films of the "clingfilm" type (polyvinylidene chloride) that depend on static electrical attraction for adhesion will only be effective if the powdered conditioning agent does not include a cationic anti-static agent. Other plastic films that do not depend on static attraction may, however, be suitable under those circumstances. Examples include Nescofilm (Trade Mark), a plasticised polyethylene film, and Parafilm (Trade Mark), a paraffin-wax-coated packaging film.

Preferably, however, the outer covering includes or consists of a metal foil, aluminium foil being especially preferred because it is non-stretching, readily laminated, readily removable, and provides a moisture-proof outer layer which also prevents or reduces perfume loss during storage. Advantageously the foil may be laminated to an outer layer of paper, so that a very thin layer of the relatively expensive foil may be used.

Some other composite materials may also combine the desired properties. For example, metallised thermoplastic (for example, polyester) film can conveniently combine moisture-impermeability and heat-sealability. Paper itself is not ideal because of its inadequate resistance to moisture, but paper coated or laminated with wax or plastics material can be highly suitable.

For example, a sachet may conveniently be formed of a laminate of metal foil/paper or paper/metal foil/paper, the term paper here being used to include nonwoven fabric. One side of the sachet may for example be of powder-permeable paper or nonwoven fabric, for example tea bag paper, laminated onto metal foil, optionally with a further outer layer of paper, and the other of impermeable material (metal foil alone, impermeable paper or nonwoven fabric alone, or a laminate). The bonding between the various layers is preferably by means of heat-sealing, using small amounts of hot-melt adhesive. The bonding between the metal foil and the permeable material is deliberately weak so that the outer (foil) layer can be peeled off immediately prior to insertion in the outer container and use.

The above discussion relates to the situation where the inner container needs to be totally or nearly totally enclosed by the outer packaging. In the case of an inner container which itself consists mainly of moistureproof, relatively durable, powder-impermeable material and which has openings localised over a relatively small area, it is clearly necessary only to cover that area itself, so that the outer packaging or covering will be small compared to the overall size of the inner container and will not be subject to such stringent requirements as regards durability and impermeability to moisture and perfume. A label or tag coated with a pressure-sensitive adhesive may be sufficient in these circumstances; this may be of any of the material already mentioned, if desired, but paper alone may be adequate for a label or tag of relatively small area.

An example of an inner container of this type is a sachet of plastics film, for example, polyethylene, having a small number of perforations positioned relatively closely together in one wall only. An adhesive-coated label of strong paper may be used to cover just the perforated region. A problem with this type of sachet arises from the low adhesiveness of plastics film, so that the label may be detached prematurely during transit or storage. This problem may be alleviated by subjecting the plastics film to a suitable surface treatment or, preferably, making the entire sachet, or the perforated wall, of a laminate of the plastics film with paper or nonwoven fabric, the latter layer being outermost. This is another example of a composite material that combines desired properties.

Many other materials and constructions are of course possible for the inner container and will readily suggest themselves to one skilled in the art.

The method and device of the invention have been found to give highly effective fabric softening, using a cheap and environmentally unobjectionable material and without the need for additives such as distributing agents.

A device according to the invention will now be described in further detail, by way of example only, with reference to the accompanying drawings, in which:

FIG. 7 is a sectional view, on an enlarged scale, of an alternative inner container;

FIG. 8 is a plan view, of approximately actual size, of the inner container of FIG. 7; and FIGS. 9, 10 and 11 are perspective views of alternative outer containers.

Figure 1:
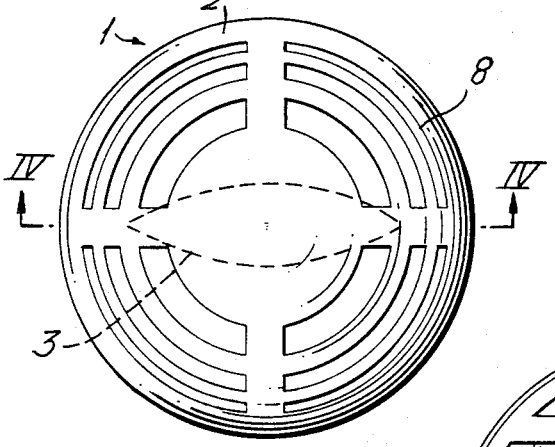
FIG. 1 is a plan view of the device.
Figure 2:
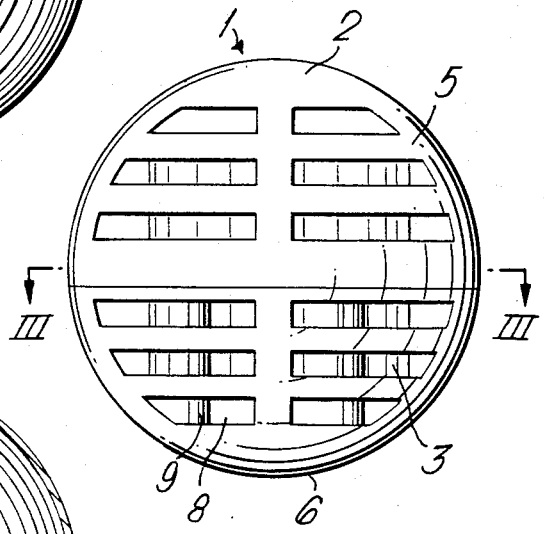
FIG. 2 is an elevation of the device.
Figure 3:
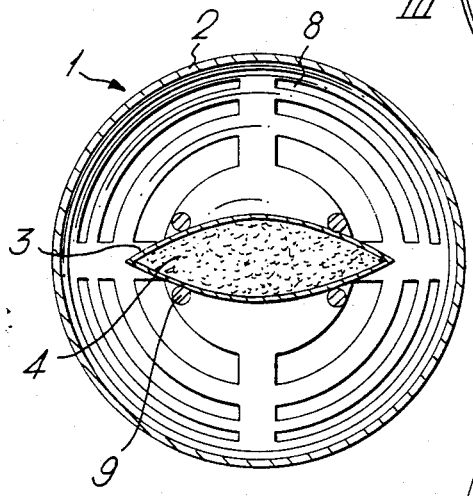
FIG. 3 is a horizontal section, taken along the line III—III of FIG. 2.
Figure 4:
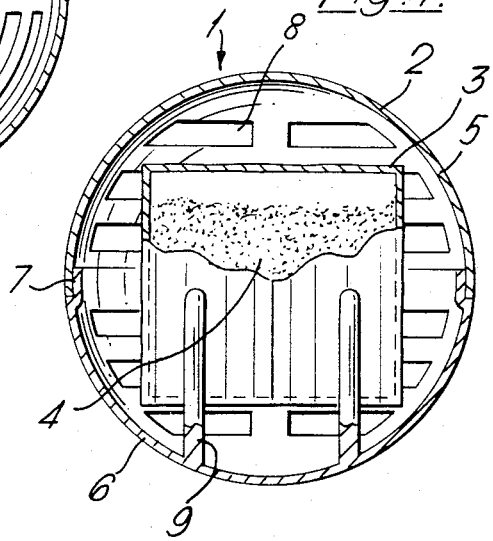
FIG. 4 is a vertical section, taken along the line IV—IV of FIG. 1.

Referring now to FIGS. 1 to 4 of the accompanying drawings, a device 1 suitable for use in the process of the invention consists of an outer container 2, and an inner container 3 containing a powdered fabric conditioning agent 4.

The outer container 2 is a hollow polypropylene sphere having a diameter of at least 6 cm, for example, 9 cm, and consisting of upper and lower hemispheres 5 and 6 fitted together by means of a firm snap-fit arrangement 7 such that the outer surface is smooth. Both hemispheres are provided with a plurality of parallel slits 8 each having a width of about 2 to 3 mm. The lower hemisphere 6 includes four integral pins 9 which extend upwardly from its base.

Wedged between the pins 9 is the inner container 3 which is a sachet of flexible porous web material of a size, for example 4 cm×4 cm, such that when wedged firmly between the pins 9 it is spaced from each wall of the sphere 2. The sachet 3 contains a powdered fabric conditioning composition milled to a particle size of 180–250 μm.

The consumer may initially be supplied, for example, with one sphere 2 and a plurality of sachets 3.

Figure 5:
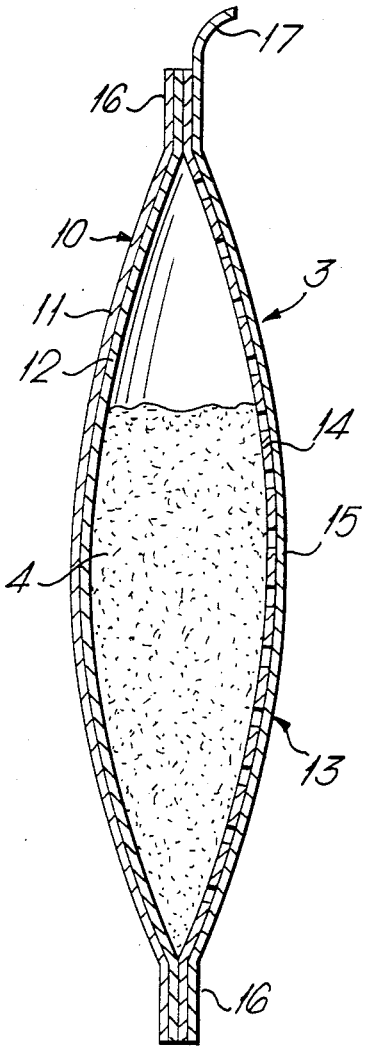
FIGS. 5 and 6 are sectional views, on an enlarged scale, of part of the device of FIGS. 1 to 4.

The sachet 3 as initially supplied to the consumer is shown in FIG. 5. A first wall 10 of the sachet 3 is of material impermeable to the powdered fabric conditioning composition 4, and consists of an outer layer 11 of aluminium foil laminated to an inner layer 12 of paper. The foil layer 11 can be very thin as it is supported and reinforced by the paper layer 12. A second wall 13 of the sachet also consists of a laminate, its inner layer 14 being of porous paper, of pore size approximately 250 μm, as used for tea and coffee bags, and its outer layer 15 being of aluminium foil. If desired an additional layer of paper (not shown) could be laminated to the outer side of one or both of the foil layers 11 and 15. This would allow even thinner layers of foil to be used. The thicknesses of all four layers shown in FIGS. 5 and 6 have of course been greatly exaggerated in for the sake of clarity.

The layers are bonded together at their edge regions 16 by means of heat-sealing, a small amount of hot-melt adhesive having been provided there for that purpose. The bond between the paper layers 12 and 14 are relatively strong whereas the bonds between the aluminium layers 11 and 15 and the paper layers 12 and 14 respectively are relatively weak, because of the inherently lower adhesion of aluminium. An end region 17 of the layer 15 extends beyond one region of sealing to form a pull-tab for the consumer.

It will be noted that the sachet 3 as shown in FIG. 5 is entirely covered with aluminium foil and its contents 4 are thus protected from atmospheric moisture; any perfume present in the composition 4 is also retained.

Figure 6:
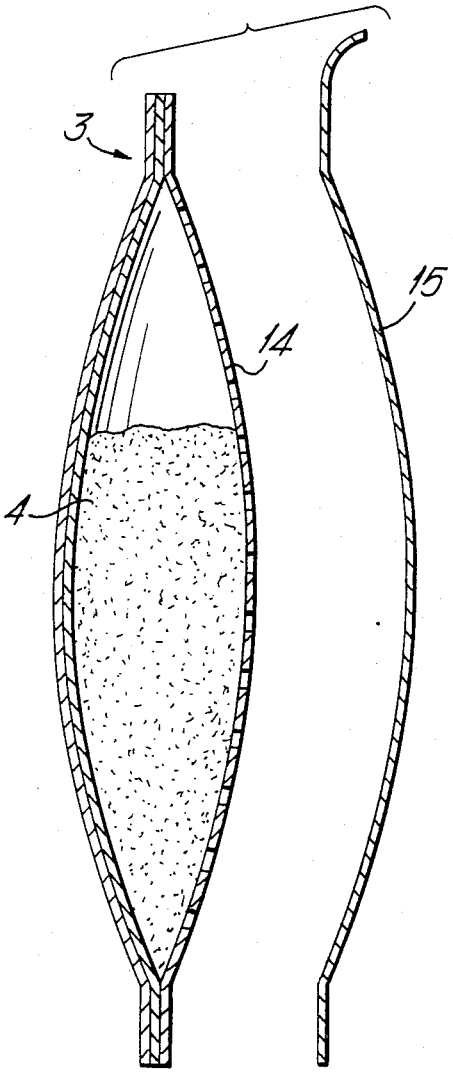

Immediately prior to use, the consumer grasps the pull tab 17 and removes the layer 15, thus exposing the permeable layer 14, as shown in FIG. 6. The layer 15 comes away easily without tearing the layer 14 or opening the seals between the other layers, because, as previously mentioned, it is bonded relatively weakly to the other parts of the sachet. The layer 15 can then be discarded and the sachet 3 is ready for use. Although the bond between the layers 11 and 12 is also relatively weak, the aluminium layer 11 does not in general come off because no pull-tab or other starting device is provided.

The consumer then snaps apart the sphere 2, wedges the sachet between the pins 9, and snaps the sphere together again. The device is now ready for use in a tumble-dryer.

FIGS. 7 and 8 shown an alternative form of sachet suitable for use in the process of the invention. The sachet 18, shown in FIG. 8 at approximately its actual size and in FIG. 7 at an enlarged scale corresponding to that of FIGS. 5 and 6, is formed of a laminate of polyethylene film 19 and paper 20, the film 19 being innermost. As shown, the sachet 18 is composed of a single sheet of laminate, one edge 21 being constituted by a fold and the other edges 22 being closed by heat-sealing; alternatively, two sheets could have been used and all four edges closed by heat-sealing. Holes 23 of approximately 2 mm (2000 μm) diameter have been punched in one wall of the sachet, the number of holes and their size having been chosen to give an appropriate delivery rate for the powder 4. The holes 23 are positioned relatively closely together so as to occupy a relatively small area of the sachet wall. An adhesive label 24, indicated in FIG. 8 by a dotted line, covers the region occupied by the holes; it adheres without difficulty to the paper of the outer sachet wall, but can readily be removed by the consumer immediately prior to use.

FIGS. 9, 10 and 11 show alternative forms of outer container for use in the process of the present invention. The container 25 of FIG. 9 is in the shape of a hexagonal prism having an aspect ratio (ratio of major axis to minor axis) of about 1:1, formed of folded resin-bonded cardboard, and having relatively large circular openings 26.

FIGS. 10 and 11 show two containers 27 and 28 of injection-moulded plastics material, each in the shape of two abutting frustocones, the containers 27 and 28 having aspect ratios of about 2:1 and about 1.5:1 respectively. Each can be separated into upper and lower parts 29 and 30 connected only by a small integral "hinge" (not shown), for insertion of an inner container, and the two parts can then be snap-fitted together.

The invention is further illustrated by the following non-limiting Examples.

EXAMPLES 1 to 21

Examples 1 to 21 demonstrate the fabric softening benefits obtained from the use of the method and device of the invention.

EXAMPLES 1–6

1.5 kg batches of unused terry towelling, each containing 12 rectangular pieces each 30×38 cm, were desized by boiling for about 30 minutes in a Hotpoint Empress (Trade Mark) washing machine in a solution containing 250 g of sodium carbonate and 58 g of non-ionic detergent in deionised water, followed by rinsing and mangling. Each desized towelling batch was then washed again in a front-loading washing machine Miele (Trade Mark) Auto 429 or AEG Lavamat Regina (Trade Mark) using a 75-minute heat-up-to-boil wash cycle, 100 g of Persil (Trade Mark) Automatic washing powder, and deionised water. The wash cycle was followed by rinsing and spinning; in some of the control experiments, as detailed below, a rinse conditioner was added at the final rinse stage. The batches were then ready for tumble-drying.

Batches of terry towelling conditioned with various soaps and soap blends, using the method of the invention, were then compared for softness with untreated control batches (A) and with batches (B) conditioned in the dryer using a commercially available impregnated sheet conditioner ("Bounce" ex Procter & Gamble). For each of the batches treated according to the invention, the conditioning agent used was 3 g powdered soap having a particle size of less than 300 μm, packed in a rectangular sachet of polyethylene sheeting having 8 2-mm holes punched on each side, the sachet being in turn placed in an outer container in the form of a hollow slitted polypropylene sphere of diameter 9.5 cm, substantially as shown in FIGS. 1 to 4 of the accompanying drawings.

Softness scores were allotted by a panel of 4 people using the following subjective scale:

0—Harsher than (A) 1—Equal to (A) 2—Softer than (A) but harsher than (B) 3—Equal to (B) 4—Softer than (B)

Average results were calculated over the 12 test pieces in each batch.

The tumble dryer used for this experiment was a Creda (Trade Mark) 400, on a high (H2) heat setting, the duration of the drying cycle being 1 hour.

The results obtained are shown in the following Table. Examples A to E are comparative, while Examples 1 to 6 are according to the invention.

| Example | Soap | Composition of fatty material | Average softness score |
|---|---|---|---|
| A | Sodium laurate | $C_{12}$ saturated | 1.1 |
| B | Sodium palmitate | $C_{16}$ saturated | 1.5 |
| C | Sodium stearate | $C_{18}$ saturated | 1.8 |
| D | Sodium coconut soap | Mainly $C_{12}$ saturated, some $C_{14}$ | 2.1 |
| E | Sodium tallow soap | Mainly $C_{16}$–$C_{18}$, mixture of saturated and unsaturated | 2.2 |
| 1 | Lux (Trade Mark) Flakes ex Lever Brothers Ltd | Tallow/coconut (about 80/20), including 5% free fatty acid | 3.3 |
| 2 | Baby soap ex Johnson & Johnson | Tallow/coconut (about 82:18) | 2.9 |
| 3 | Palmolive (Trade Mark) ex Colgate-Palmolive | Tallow/coconut (about 85:15) | 3.1 |
| 4 | Shield (Trade Mark) ex Lever Brothers Ltd | Tallow/coconut (about 82:18) | 3.1 |
| 5 | Imperial Leather (Trade Mark) ex Cussons | Tallow/coconut (about 83:17) | 3.4 |
| 6 | Lux (Trade Mark) toilet soap ex Lever Brothers Ltd | Tallow/coconut (about 60:40), including 7.5% free fatty acid | 3.1 |

Comparative Examples A to C show the performances of single-chain-length saturated soaps. These all had some softening effect, as demonstrated by scores greater than 1, but sodium laurate gave very little improvement. As the chain length increased, the softening performance improved slightly.

Comparative Examples D and E demonstrate that somewhat better results were obtained using mixed-chain-length soaps obtained from natural oils and fats. The results for sodium coconut and tallow soaps were both better than that for sodium stearate. However, the performances were still worse than that of the Bounce sheet.

Example 1 demonstrates that the use of a blend of naturally derived soaps, with a wide spread of chain length from $C_{12}$ to $C_{18}$, gave substantially better results. The score here was better than for the commercially available impregnated sheet Bounce.

Examples 2 to 6 illustrate the use of various commercially available toilet soaps, both superfatted and otherwise. All displayed results comparable to or better than that of Bounce when used at a level of 3 g.

Unlike the laboratory grade soaps used in Comparative Examples A to C the commercial soaps used in Examples 1 to 6 contained appreciable amounts of moisture. The moisture contents of these products vary according to age and processing but are generally less than 15%. Typical values are 3–5% for the flakes of Example 1, 11–14% for the non-superfatted toilet soaps of Examples 2 to 5, and 9–11% for the superfatted toilet soap of Example 6.

EXAMPLES 7 TO 12

In the following experiments the effect of soap level on performance was investigated, using Lux toilet soap, Imperial Leather toilet soap and Lux flakes at levels of 3 g, 6 g, and 9 g. The particle size of each soap used was again less than 300 μm, and the soaps were dispensed from a dispensing device (a polyethylene sachet within a polypropylene ball) as described in Examples 1 to 6. In each run three batches of towelling treated with a soap at the three different levels were compared with three control batches, one of which had received no conditioning treatment, one of which had been conditioned in the dryer with a Bounce impregnated sheet, and one of which had been treated in the rinse with the recommended dose of a commercially available rinse conditioner (Comfort (Trade Mark) ex Lever Brothers Ltd).

After drying, the variously treated samples of towelling were compared by a panel of 4 judges. The results were statistically normalised onto an arbitrary harshness scale in which the softest samples (those treated with Comfort in the rinse) were assigned a score of 3.0 while the harshest samples (those given no specific softening treatment) were assigned a score of 7.5. On this scale a difference of 1.0 represents 95% significance.

The first three runs (Examples 7 to 9) were carried out using a tumble-dryer on a low heat setting. The duration of the drying cycle was 1½ hours. For Example 7 a Bendix (Trade Mark) 7447 dryer was used, and for Examples 8 and 9 a Creda 400 dryer was used.

Examples 10 to 12 were carried out using a Creda 400 machine on a high heat setting; the duration of the dryer cycle was 1 hour.

| | | Harshness scores | | | |
|---|---|---|---|---|---|
| Conditioning system | Conditioner delivered (g) | Example 7 (Lux toilet soap) | Example 8 (Lux toilet soap) | Example 9 (Imperial Leather) | Average of the 3 runs |
| Powdered soap | 3 | 6.2 | 5.8 | 6.5 | 6.2 |
| | 6 | 5.0 | 4.8 | 4.2 | 4.7 |
| | 9 | 4.5 | 4.7 | 3.7 | 4.3 |
| None | — | 7.5 | 7.5 | 7.5 | 7.5 |
| Bounce sheet | 0.50–0.80* | 5.6 (0.80) | 6.9 (0.50) | 7.0 (0.65) | 6.5 (0.65) |
| Comfort in rinse | — | 3.0 | 3.0 | 3.0 | 3.0 |

*The weight of conditioner delivered in each run is shown in brackets after the harshness score

| | | Harshness scores | | | |
|---|---|---|---|---|---|
| Conditioning system | Conditioner delivered (g) | Example 10 (Lux toilet soap) | Example 11 (Lux flakes) | Example 12 (Imperial Leather) | Average of the 3 runs |
| Powdered soap | 3 | 5.7 | 5.7 | 5.3 | 5.6 |
| | 6 | 4.9 | 4.6 | 4.7 | 4.7 |
| | 9 | 4.1 | 4.5 | 4.6 | 4.4 |
| None | — | 7.5 | 7.5 | 7.5 | 7.5 |
| Bounce sheet | 1.30–2.80 | 6.1 (1.30) | 4.7 (2.80) | 6.4 (1.31) | 5.7 (1.80) |
| Comfort in rinse | — | 3.0 | 3.0 | 3.0 | 3.0 |

The results averaged over all six runs were as follows:

| Conditioning treatment | Harshness score |
|---|---|
| Soap (3 g) | 5.9 |
| Soap (6 g) | 4.7 |
| Soap (9 g) | 4.4 |
| None | 7.5 |
| Bounce sheet (average delivery 1.22 g) | 6.1 |
| Comfort in rinse | 3.0 |

It may be seen that at the 3 g level the results obtained with soap were similar to, and generally slightly better than, those obtained with the Bounce sheet. Use of 6 g of soap gave a substantial improvement (more than 1 score unit). Further increase of the soap dose to 9 g gave only a small additional improvement.

EXAMPLES 13–17

In this series of experiments the effect of soap particle size at a constant dose of 6 g was investigated, at both low and high heat settings, in a Creda 400 tumble-dryer, using the methodology of Examples 7 to 12. The particle size ranges investigated were 90–180 μm, 180–250 μm and 250–300 μm. For this series of tests the sachets used for the soap differed from those used in Examples 1 to 12 in that they contained only 2 holes per side. The soaps used were Lux toilet soap and Imperial Leather.

The results obtained at a low heat setting (1½-hour drying cycle) were as follows:

| Conditioning system | Conditioner delivered (g) | Harshness scores: Example 13 (Lux toilet soap) | Example 14 (Imperial leather) | Average of both runs |
|---|---|---|---|---|
| Powdered soap (90–180 μm) | 6 | 4.3 | 5.0 | 4.7 |
| Powdered soap (180–250 μm) | 6 | 3.8 | 5.0 | 4.4 |
| Powdered soap (250–300 μm) | 6 | 4.5 | 5.9 | 5.2 |
| None | — | 7.5 | 7.5 | 7.5 |
| Bounce sheet | 0.6–0.7 | 6.6 (0.70) | 7.2 (0.60) | 6.9 (0.65) |
| Comfort in rinse | — | 3.0 | 3.0 | 3.0 |

All three particle sizes gave results significantly better than the Bounce sheet, the 180–250 μm cut being the best. It will be noted that the result using Lux toilet soap at this particle size was exceptionally good.

The results obtained at a high heat setting (1-hour drying cycle) were as follows:

| Conditioning system | Conditioner delivered (g) | Harshness scores: Example 15 (Lux toilet soap) | Example 16 (Imperial Leather) | Example 17 (Imperial Leather) | Average of the 3 runs |
|---|---|---|---|---|---|
| Powdered soap (90–180 μm) | 6 | 5.3 | 5.5 | 4.7 | 5.2 |
| Powdered soap (180–250 μm) | 6 | 4.8 | 4.4 | 4.4 | 4.5 |
| Powdered soap (250–300 μm) | 6 | 5.2 | 5.0 | 5.2 | 5.2 |
| None | — | 7.5 | 7.5 | 7.5 | 7.5 |
| Bounce sheet | 0.50–1.80 | 5.5 (1.80) | 4.9 (1.80) | 6.0 (0.50) | 5.5 (1.40) |
| Comfort in rinse | — | 3.0 | 3.0 | 3.0 | 3.0 |

These results too show a preference for the 180–250 μm cut, which was still significantly better than the Bounce sheet despite the considerably better performance of the latter at high heat settings.

When averaged over all five runs the results show similar trends, both the smaller-particle-size cuts being significantly better than the Bounce sheet:

| Conditioner system | Harshness score |
|---|---|
| Powdered soap (6 g): | |
| 90–180 μm | 5.0 |
| 180–250 μm | 4.5 |
| 250–300 μm | 5.2 |
| None | 7.5 |
| Bounce sheet (1.1 g delivered) | 6.0 |
| Comfort in rinse | 3.0 |

EXAMPLES 18 & 19

Examples 13 and 14 were repeated using a slightly different dispensing device: instead of polyethylene sheet sachets, sachets (of the same size) of Crompton (Trade Mark) 65031 AB tea bag paper having an average pore size of about 75 μm were used. The tumble dryer used was a Creda Reversair (Trade Mark) on a low heat setting (1½ hour cycle). The results were as follows:

| Conditioning system | Conditioner delivered (g) | Harshness scores: Example 18 (Lux toilet soap) | Example 19 (Imperial leather) | Average of both runs |
|---|---|---|---|---|
| Powdered soap (90–180 μm) | 6 | 4.7 | 4.6 | 4.7 |
| Powdered soap (180–250 μm) | 6 | 5.0 | 4.7 | 4.9 |
| Powdered soap (250–300 μm) | 6 | 6.2 | 5.2 | 5.7 |
| None | — | 7.5 | 7.5 | 7.5 |
| Bounce sheet | 0.50–0.60 | 7.0 (0.60) | 6.2 (0.50) | 6.6 (0.55) |
| Comfort in rinse | — | 3.0 | 3.0 | 3.0 |

Using this type of sachet with much smaller openings appeared to give a marginal advantage to the 90–180 μm cut, but both this and the 180–250 μm cut were significantly better than the Bounce sheet. As might be expected, the 250–300 μm cut was less effective using this type of delivery system, although still better than Bounce.

EXAMPLES 20 & 21

These examples demonstrate the softening effect of blends of soap and cationic softener when delivered as powders from a device as described in Examples 1 to 6.

Mixed loads (2.5 kg each) of cotton and synthetic fabrics, including terry towelling monitors, were washed in a Miele (Trade Mark) Auto 429 front-loading washing machine, using a heat-up-to-60° C. cycle, Persil (Trade Mark) Automatic and deionised water. The wash cycle was following by rinsing and spinning, and, as in Examples 1 to 6, in some control experiments a rinse conditioner was added at the final rinse stage.

The batches were then tumble-dried in a Creda Reversair machine using both low and high heat settings. Control batches were tumbled without conditioner (some of these having been pretreated with rinse conditioner as described in Examples 1 to 6), while others were tumbled with Bounce sheets as described previously.

Samples from each batch were compared by a panel of 4 judges and the results were processed, as described in Examples 7 to 12, to give a harshness score.

EXAMPLE 20

The fabric conditioner used according to the invention was a mixture of 5 g powdered Lux toilet soap, of particle size 90–250 μm, and 1 g powdered distearyl dimethyl ammonium chloride (Arosurf (Trade Mark) TA 100 ex Ashland Chemical Company), of particle size 90–180 μm. This mixture was delivered using a device as described in Examples 1 to 6. The results of the comparative experiment were as follows:

| Conditioning system | Harshness score | |
|---|---|---|
| | Low heat | High heat |
| Soap/Arosurf | 4.1 | 4.8 |
| None | 7.5 | 7.5 |
| Bounce sheet | 6.6 | 6.5 |
| Comfort in rinse | 3.0 | 3.0 |

It will be noted, by comparison with Examples 7–12, that the result at the high heat setting is very similar to that with soap alone, and the result at the low heat setting is even better.

No static cling was observed when the load was removed from the dryer.

EXAMPLE 21

This procedure was repeated using a 3:1 by weight ratio of soap to Arosurf (total 6 g). The results were as follows:

| Conditioning system | Harshness score | |
|---|---|---|
| | Low heat | High heat |
| Soap/Arosurf | 3.7 | 4.1 |
| None | 7.5 | 7.5 |
| Bounce sheet | 6.9 | 6.8 |
| Comfort in rinse | 3.0 | 3.0 |

The results were slightly, but not significantly, better than those of Example 20.

Again, no static cling was observed when the load was removed from the dryer.

EXAMPLES 22–24

Examples 22–24 illustrate the use of the method and device of the invention in reducing static cling in tumble-dried synthetic fabrics.

EXAMPLE 22

Two 1.5 kg loads of nylon sheeting were washed in an automatic front-loading washing machine using a heat-up-to-60° C. cycle, and were then tumble-dried in a Creda 400 dryer at a high heat setting, the duration of the drying cycle being 1 hour.

The first load (control) was dried without the addition of any form of conditioning agent. When the load was removed from the dryer at the end of the cycle, the pieces of nylon sheeting clung to each other and were charged with static electricity; a certain amount of crackling occurred when they were pulled apart.

The second load was dried together with a ball device as described in Examples 1 to 6, of which the inner container was a polyethylene sachet punched with 8 2-mm holes and containing 6 g of powdered Lux toilet soap (particle size below 300 μm). When the load was removed from the dryer, no static cling was observed.

EXAMPLE 23

Three 2 kg loads of mixed fabrics (synthetic sheeting and terry towelling) were washed as described in Examples 1 to 19 and dried in a Bendix 7447 tumble-dryer at a low heat setting (1½ hour drying cycle).

The first load (control) was dried without the addition of any form of conditioning agent. When the load was removed from the dryer, a build-up of static charge was apparent from the fact that the fabric pieces clung together and sparking and crackling occurred when they were pulled apart.

The second load was dried together with a ball device as described in Examples 1 to 6, of which the inner container was a polyethylene sachet punched with 2 2-mm-holes. The sachet contained a mixture of 5 g powdered soap (80% tallow, 20% coconut, 12% water content) having a particle size range of 90–250 μm and incorporating 1% perfume, and 1 g of a powdered cationic fabric conditioner (Arosurf TA 100 as mentioned previously) having a particle size range of 180–250 μm. This second load, when removed from the dryer at the end of the cycle, was substantially free of static cling.

The test was repeated using a Creda Reversair dryer and similar results were obtained.

EXAMPLE 24

Example 23 was repeated using, instead of 5 g soap and 1 g cationic fabric conditioner, a mixture of 5.5 g soap and 0.5 g cationic fabric conditioner. Similar results were obtained.

We claim:

1. In a method of conditioning fabrics, which comprises tumbling damp fabrics under the action of heat in a laundry dryer together with a fabric conditioning agent in the form of a free-flowing powder having a particle size range within the range of from 20 to 1000 μm, the improvement wherein said powder includes at least 55% by weight of a blend of soaps of $C_8$ to $C_{22}$ saturated or unsaturated fatty acids, said soap blend containing at least 5% by weight of $C_{12}$ soap, at least 5% by weight of $C_{14}$ soap, at least 12% by weight of $C_{16}$ soap and at least 20% by weight of $C_{18}$ soap, said soap blend being in the form of a powder free of any protective coating.

2. The method of claim 1, wherein the soap blend contains at least 7% by weight of $C_{12}$ soap, at least 6% by weight of $C_{14}$ soap, at least 15% by weight of $C_{16}$ soap and at least 25% by weight of $C_{18}$ soap.

3. The method of claim 2, wherein the soap blend contains from 7 to 27% by weight of $C_{12}$ soap, from 6 to 12% by weight of $C_{14}$ soap, from 18 to 28% by weight of $C_{16}$ soap and from 32 to 54% by weight of $C_{18}$ soap.

4. The method of claim 1, wherein the soap blend contains at least 20% by weight of $C_{18}$ unsaturated soap.

5. The method of claim 4, wherein the soap blend contains from 22 to 38% by weight of $C_{18}$ unsaturated soap.

6. The method of claim 1, wherein the soap blend contains from 45 to 85% by weight of tallow soap and from 15 to 55% by weight of coconut soap.

7. The method of claim 1, wherein the particle size range of the powder is within the range of from 70 to 500 μm.

8. The method of claim 7, wherein the particle size range of the powder is within the range of from 90 to 250 μm.

9. The method of claim 1, wherein the powdered fabric conditioning agent consists to an extent of at least 65% by weight of soap.

10. The method of claim 1, wherein the fabric conditioning agent consists essentially of soap in admixture with a cationic material in powder form capable of reducing static cling.

11. The method of claim 10, wherein the cationic material comprises a quaternary ammonium salt.

12. The method of claim 10, wherein the weight ratio of soap to cationic material is within the range of from 12.1 to 1.5:1.

13. The method of claim 10, wherein the weight ratio of soap to cationic material is within the range of from 11:1 to 2:1.

14. The method of claim 1, wherein the powdered fabric conditioning agent consists substantially wholly of soap.

15. The method of claim 1, wherein the amount of powdered fabric conditioning agent used per fabric load is within the range of from 1.5 to 12 g.

16. The method of claim 15, wherein the amount of powdered fabric conditioning agent used per fabric load is within the range of from 2.5 to 10 g.

17. The method of claim 15, wherein the amount of powdered fabric conditioning agent used per fabric load is within the range of from 2.5 to 70 g.

18. The method of claim 1, wherein the powdered fabric conditioning agent is sprinkled onto the fabrics during drying from a dispensing device that can move freely among the fabrics in the tumble dryer.

19. A device for conditioning fabrics in a tumble dryer, said device comprising a container having a plurality of openings the largest dimension of which does not exceed 2.5 mm, said container containing from 1.5 to 12 g of a fabric conditioning agent in the form of a free-flowing powder having a particle size range within the range of from 20 to 1000 μm, said powder consisting to an extent of at least 55% by weight of a blend of soaps of $C_8$ to $C_{22}$ saturated or unsaturated fatty acids, said soap blend containing at least 5% by weight of $C_{12}$ soap, at least 5% by weight of $C_{14}$ soap, at least 12% by weight of $C_{16}$ soap and at least 20% by weight of $C_{18}$ soap, said soap blend being in the form of a powder free of any protective coating.

20. The device of claim 19, wherein said container comprises a sachet of flexible sheet material.

21. The device of claim 20, wherein the first container is a sachet of material selected from the group consisting of paper, nonwoven fabrics, plastics films and laminates of any two or more of said materials.

22. The device of claim 19, wherein the container is provided with a removable outer covering, impermeable to the fabric conditioning agent, which covers all said openings and is in intimate contact within said container in the region of said openings.

23. The device of claim 22, wherein the first container is a sachet of paper or nonwoven fabric permeable to the powdered fabric conditioning agent over part or whole of its area, and the outer covering comprises metal foil laminated to said paper or nonwoven fabric, at least part of said metal foil being readily removable to expose a permeable area of said paper or nonwoven fabric.

24. The device of claim 22, wherein the first container is a sachet of plastics film having paper or nonwoven fabric laminated thereto on its outermost side and having a plurality of openings for the passage of powdered fabric conditioner, and the outer covering comprises one or more pieces of paper coated with pressure-sensitive adhesive positioned so as to cover and close said openings.

25. The device of claim 19, wherein said container is within a second container having openings for the egress of said powdered fabric conditioner, said second container being substantially form-retaining and of a shape such as to allow ready movement thereof among the fabrics in a dryer.

26. The device of claim 25, wherein said second container is of a size such that its largest dimension is at least 6 cm.

27. The device of claim 25, wherein said second container is of thermoplastic material having a softening point above 130° C.

28. The device of claim 25, wherein said second container is of polypropylene or high-density polyethylene.

29. The device of claim 25, wherein said second container is such a shape that the ratio of its principal axes (major to minor) is less than 3:1.

30. The device of claim 25, wherein said second container is such a shape that the ratio of its principal axes (major to minor) is approximately 1:1.

31. The device of claim 25, wherein said second container substantially approximates to a shape selected from the group consisting of a sphere, a spheroid, an ellipsoid, a cylinder, a frustocone, a cube, two abutting frustocones and a hexagonal prism.

* * * * *